US010689171B1

(12) United States Patent
Potash

(10) Patent No.: US 10,689,171 B1
(45) Date of Patent: Jun. 23, 2020

(54) CONTAINER WITH LID FOR FACILITATING MIXING OF MATERIALS USED FOR CONSTRUCTION AND MAINTENANCE

(71) Applicant: Mark R. Potash, Pennsburg, PA (US)

(72) Inventor: Mark R. Potash, Pennsburg, PA (US)

( * ) Notice: Subject to any disclaimer, the term of this patent is extended or adjusted under 35 U.S.C. 154(b) by 168 days.

(21) Appl. No.: 15/956,861

(22) Filed: Apr. 19, 2018

(51) Int. Cl.
*B65D 51/32* (2006.01)
*B44D 3/12* (2006.01)
*B01F 7/00* (2006.01)

(52) U.S. Cl.
CPC ..... *B65D 51/32* (2013.01); *B01F 7/0095* (2013.01); *B01F 7/00941* (2013.01); *B44D 3/127* (2013.01); *B01F 2215/005* (2013.01); *B65D 2217/00* (2013.01)

(58) Field of Classification Search
CPC . B65D 51/32; B65D 2217/00; B01F 7/00941; B01F 7/0095; B01F 2215/005; B44D 3/127
USPC ..... 366/209
See application file for complete search history.

(56) References Cited

U.S. PATENT DOCUMENTS

| | | | | |
|---|---|---|---|---|
| 5,676,463 | A * | 10/1997 | Larsen | B01F 7/1695 366/251 |
| 6,802,642 | B2 | 10/2004 | Fallenius | |
| 7,967,497 | B2 | 6/2011 | Whitney | |
| 9,084,971 | B1 * | 7/2015 | Villasenor | B05B 7/2408 |
| 9,492,799 | B1 * | 11/2016 | Villasenor | B01F 7/00208 |
| 2005/0018533 | A1 * | 1/2005 | Whitney | A46B 17/06 366/129 |
| 2015/0165396 | A1 * | 6/2015 | Mattson | B01F 7/00058 366/279 |
| 2019/0270559 | A1 * | 9/2019 | Zalewski | B65D 41/04 |

* cited by examiner

*Primary Examiner* — Huy Tram Nguyen
(74) *Attorney, Agent, or Firm* — Sanchelima & Associates, P.A.; Christian Sanchelima; Jesus Sanchelima

(57) ABSTRACT

The present invention is a container lid to be fitted on a container having materials used for constructions and/or maintenance of a structure and container lid facilitates mixing. Moreover, container lid has at least one mixer hole that is capable for permitting a portion of mixing paddle to pass through. When container lid is positioned over container, mixing paddle is rotated power drill, operated by a user, to mix materials within the container. Also, container lid has openings for permitting material/aid for mixing like water so that material/aid reaches container and enables mixing. Container lid and container are formed from existing material boxes like paintboxes, and hence such mixing is possible at a very low cost.

18 Claims, 5 Drawing Sheets

CONTAINER WITH LID FOR FACILITATING MIXING OF MATERIALS USED FOR CONSTRUCTION AND MAINTENANCE

BACKGROUND OF THE INVENTION

Field of the Invention

The present disclosure relates to a lid of a container that facilitates mixing of materials. More particularly, the present disclosure relates to a container lid that is capable of permitting mixer to pass therethrough to perform mixing of materials used for construction or maintenance of a structure and allow passage of materials or aid for mixing therethrough.

Description of the Related Art

Constructing a structure or building or maintaining a house requires various materials like paint, thinset, spackle and the like other materials. Sometimes, two or more different types of materials are required to be mixed, Mixing performed manually in an open container is a tiresome task and also mess the surrounding place. Thus, mixing of materials needs to be performed outdoor irrespective of prevailing environmental conditions. For instance, a person mixing material may need to bear extreme cold or hot environmental temperatures just to avoid mess at interior of home. Various mixing devices are available that is capable to mix materials. However, such mixing devices are difficult to carry each time at various sites where work is in progress. Also, such mixing devices are costly and cannot be afforded by low-budget workmen.

Several designs of various mixing devices for mixing construction/maintenance materials have been designed in the past. None of them, however, include a low cost container with lid that facilitates mixing by utilizing available sources.

Applicant believes that a related reference corresponds to U.S. Pat. No. 6,802,642 filed by Per-Ivar Fallenius titled 'Method for mixing liquid in a container and the container for carrying out the method' in which a container is used for filling liquids to be mixed and enclosed with a lid having a small opening. However, patent U.S. Pat. No. 6,802,642 differs from the present invention because container is subjected to circulatory motion for enabling mixing. Circulating container filled with liquid requires more power consumption and also requires cost-intensive system that can provide circulatory motion.

U.S. Pat. No. 7,967,497 filed by Mike Whitney titled 'Geometric and perforated paint mixer and paint roller cleaner' that includes a perforated paddle with oppositely deflected upper portions to enhance mixing of the paint. However, patent U.S. Pat. No. 7,967,497 does not explicitly mention about prevention of spill while mixing. Also, additional perforated paddles needs to be purchased and carried each time and is not convenient for labors working with low cost.

Other documents describing the closest subject matter provide for a number of more or less complicated features that fail to solve the problem in an efficient and economical way. None of these patents suggest the novel features of the present invention.

SUMMARY OF THE INVENTION

In view of the above, it is an objective of the present invention to solve or at least reduce the problems discussed above. The present invention is a container lid to be fitted on a container having materials used for constructions and/or maintenance of a structure and container lid facilitates mixing. Moreover, container lid has at least one mixer hole that is capable for permitting a portion of mixing paddle to pass through. When container lid is positioned over container, mixing paddle is rotated by power drill to mix materials within the container. Also, container lid has openings for permitting material/aid for mixing like water so that material/aid reaches container and enables mixing.

It is one of the main objects of the present invention is to provide an existing container lid of an existing container for facilitating mixing of materials used for construction and maintenance.

It is another object of this invention is to provide a container lid that permits passage of materials/aid to be mixed therethrough in container and also facilitate mixer to pass therethrough for mixing materials without any mess in surroundings.

It is another object of this invention is to provide a container lid for facilitating mixing of materials that facilitates mixing at lower cost and is convenient.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
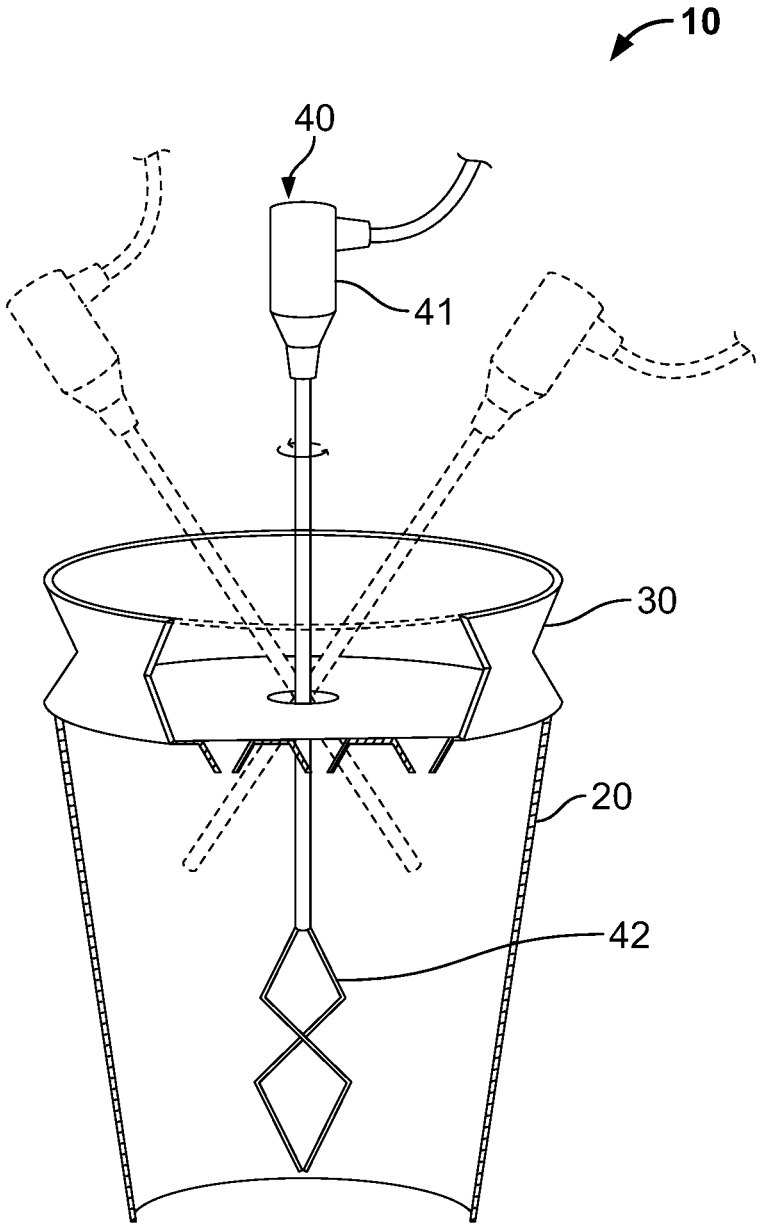
FIG. 1 represents a perspective view of a container lid fitted on a container, in accordance with one embodiment of the present invention, wherein a mixer is introduced in container for mixing various materials.

Referring now to the drawings (FIGS. 1 to 5*b*), where the present invention is generally referred to with numeral 10, it can be observed that a container lid is provided that facilitates mixing of materials used for constructions and/or maintenance of a structure that includes a container 20 and a lid 30 which is to be used in conjunction with a mixer 40.

Mixer 40 includes a power drill 41 and a mixing paddle 42. Mixing paddle 42 is rotated by power drill 41 to enable mixing.

Container 20 can be of varied sizes such as one gallon size or five gallon size and so on. Container 20 is generally cylindrical is shape, however, other shapes of container 20 are within the scope of the present disclosure. Container 20 can be an existing container of a paint box or of any other like ingredients that has a lid or can be fitted with a lid. Usage of existing container provides advantage in cost and thereby making it affordable for low-waged workers. Alternatively, a new container specially defined for mixing can be utilized.

Figure 2A:
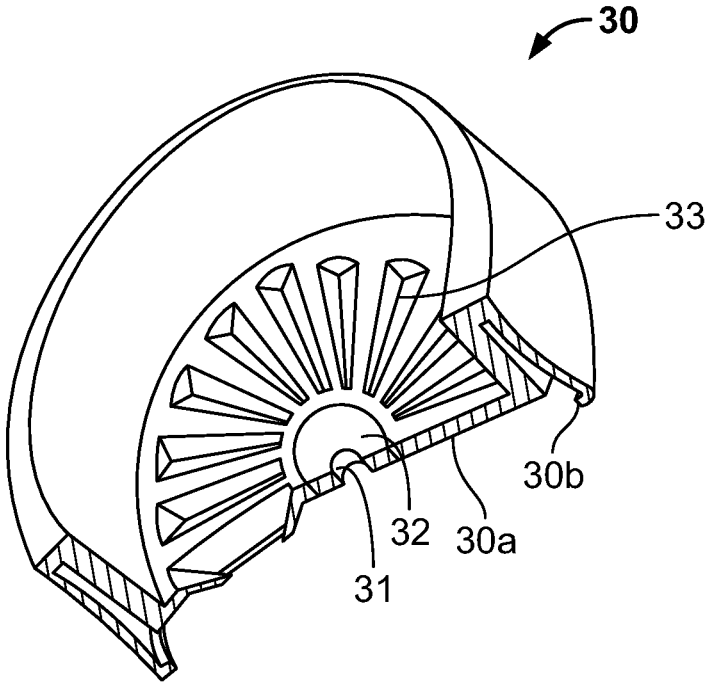
FIG. 2*a* shows a perspective cross-sectional view of a container lid of FIG. 1, wherein container lid has longitudinal perforations.
Figure 2B:
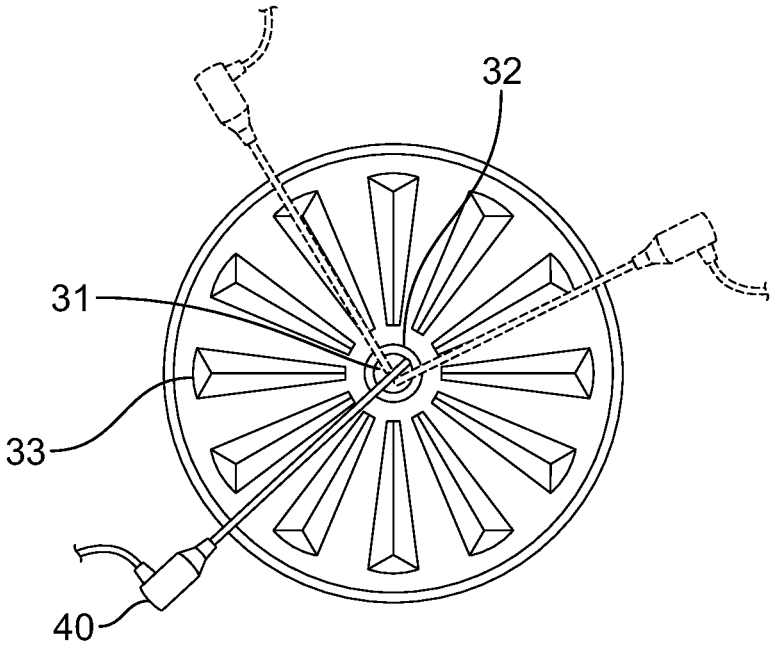
FIG. 2*b* shows a top view of a container lid of FIG. 2*a;*
Figure 2C:
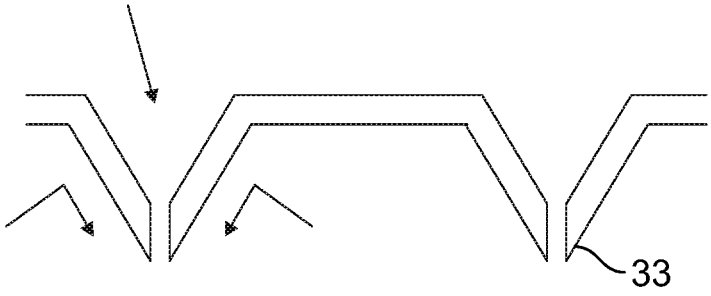
FIG. 2*c* illustrates an enlarged view of longitudinal perforations of FIG. 2*a;*
Figure 3A:
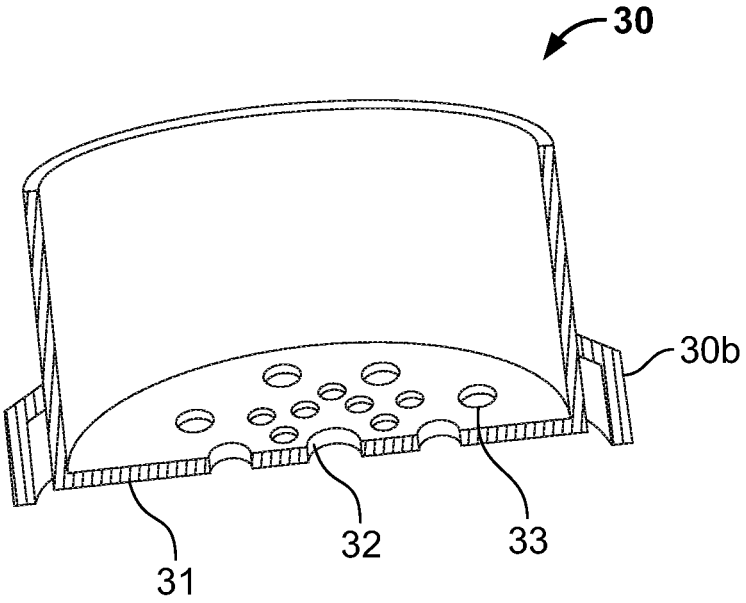
FIG. 3*a* shows a perspective cross-sectional view of container lid of FIG. 1, wherein container lid has circular perforations.
Figure 3B:
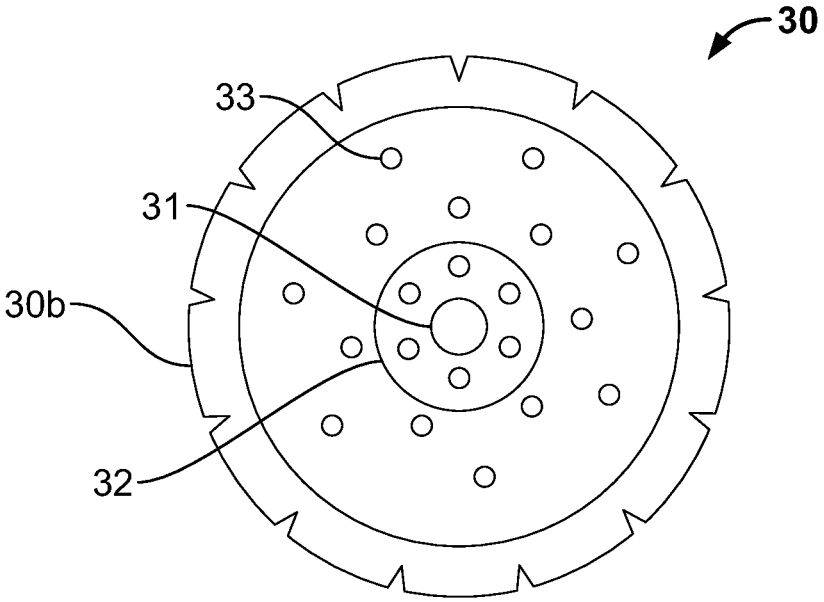
FIG. 3*b* shows a top view of a container lid of FIG. 3*a;*
Figure 4:
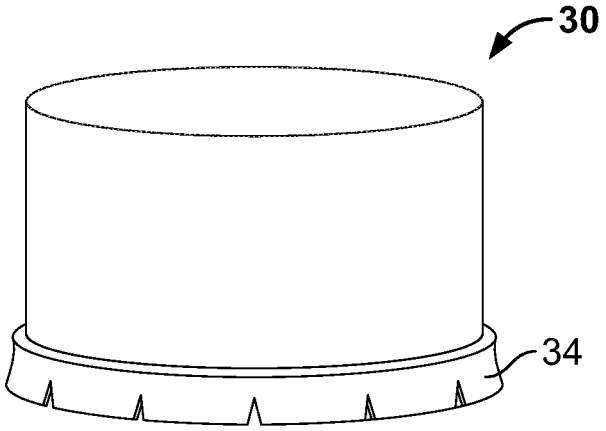
FIG. 4 illustrates a side view of container lid of FIG. 1.
Figure 5A:
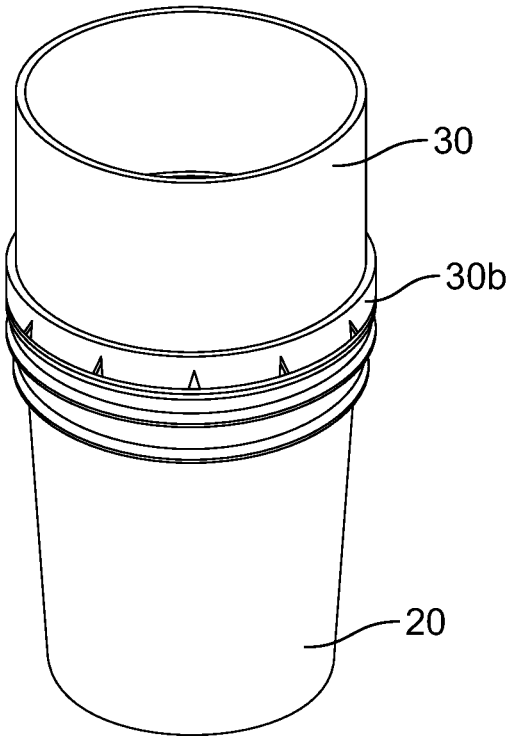
FIG. 5*a* shows a perspective view of an existing container lid of FIG. 1, wherein existing container lid is mounted on existing container.
Figure 5B:
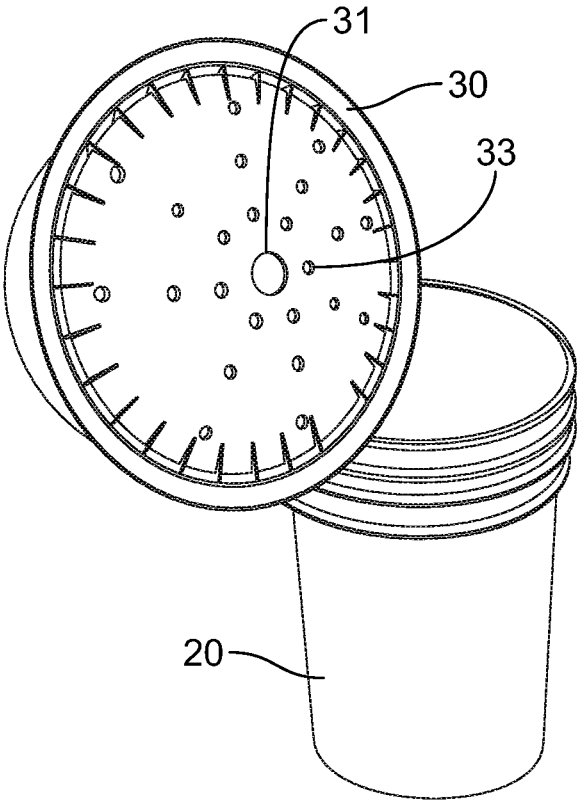
FIG. 5*b* shows a perspective view of an existing container lid of FIG. 1, wherein existing container lid is mounted on existing container.

Lid 30 is fitted on container 20 and can be a new lid 30 or an existing lid 30 basically of the container 20. Shape of lid 30 is identical to shape of container 20 such that lid 30 properly enclosed container 20. Lid 30 has a bottom portion 30*a* with a lip 30*b* that is configured with at least one mixer hole 31, at least one grommet 32 and a plurality of openings 33. Mixer hole 31 is capable to allow mixing paddle 42 to pass therethrough such that mixing paddle 42 can be inserted into container 20. Grommet 32 is placed within mixer hole 31 to reinforce mixer hole 31. Openings 33 are provided that enables addition of existing or new ingredients/aid/materials within container 20. Openings 33 can be of various shapes and sizes. For example, as shown in FIGS. 2*a* to 2*c*, openings 33 are longitudinal perforations. Alternatively, openings 33 as shown in FIGS. 3*a*, 3*b* and 5*b*, are circular perforations. If existing lid 30 is used then at least one mixer hole, at least one hole for grommet and a plurality of openings are required to be drilled therethrough. Lip 30*b* enables proper positioning of container lid 30 on container 20. Also, a locking arrangement (not illustrated in Figures) can be provided that can lock and unlock container lid 30 on container 20.

In operation, container 20 is filled with various materials/ingredients/aid like two or more of paint, thinset, spackle, grout, cement, drywall mud, wall and ceiling textures, epoxies, chemicals, water or the like. Lid 30 is fitted on container 20. Mixing paddle 42 of mixer 40 is inserted into container 20 through mixer hole 21. Mixing paddle 42 can be rotated in all direction that is it is rotatable around 360 degrees by moving power drill 41. Such flexibility of rotation of mixing paddle 42 enables adequate rotation in all peripheries of container 20. User (not illustrated in Figures) can actuate power drill 41 and mix materials/ingredients/aid provided within container 20. If required, user may release some ingredients like water on lid 30 which moves in container 20 through openings 23, Thus, user carries out mixing operation in a closed container which prevents spilling and creating mess in surroundings.

In one embodiment, mixing paddle 42 is inserted from below portion of mixer hole 21 and then power drill 41 is connected to mixing paddle 42 from top portion. In another embodiment, mixing paddle 42 connected to power drill 41 and then mixing paddle is inserted from top of mixer hole 21.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A material mixing device, comprising:

a container, a lid, a mixer including a power drill and a mixing paddle rotated by said power drill, said lid including lid sidewalls that extend upwardly and away from said lid, said lid sidewalls extending about a perimeter of said lid, said lid further including a plurality of openings, said plurality of opening being longitudinal perforations extending from a center of said lid to said lid sidewalls, said longitudinal perforations further extending beneath of said lid.

2. The material mixing device of claim 1 wherein said container is cylindrical.

3. The material mixing device of claim 1 wherein said lid and said container each have a cooperating circumference adapted to permit said lid to be mounted to said container.

4. The material mixer of claim 1 wherein said lid has a bottom portion having a lip at its periphery, said lid further including at least one mixer hole and at least one grommet, said at least one mixer hole is adapted to allow said mixing paddle to pass through so that said mixing paddle can be inserted into said container.

5. The material mixer of claim 4 wherein said grommet reinforces said at least one mixer hole.

6. The material mixer of claim 1 wherein said plurality of openings are adapted to permit the insertion of various materials into said container.

7. The material mixer of claim 1 including a locking assembly to lock and unlock said container to said lid.

8. The material mixer of claim 1 wherein said mixing paddle is flexible and is rotated 360 degrees, said at least one mixer hole includes a top and bottom, said mixing paddle is inserted into said at least one mixer hole from the bottom of said mixer hole, said power drill is inserted into said at least one mixer whole from said top, said power drill is then connected to said mixer paddle.

9. The material mixer of claim 1, wherein said mixing paddle includes paddle openings, said paddle openings further defined as a top opening and a bottom opening, said top opening being above of said bottom opening.

10. The material mixer of claim 9, wherein said top opening has a narrow top end and said bottom opening has a narrow bottom end.

11. The material mixer of claim 9, wherein said top opening and bottom opening taper.

12. The material mixer of claim 9, wherein said top opening and said bottom opening include pointed lateral sides, said top opening and said bottom opening taper inwardly away from said pointed lateral sides.

13. The material mixer of claim 9, wherein said top opening and said bottom opening define a FIG. 8 shape, said FIG. 8 shape being defined by a diamond shape of each of said top opening and said bottom opening.

14. The material mixer of claim 9, wherein said bottom opening is larger than said top opening, said bottom opening having a length greater than that of said top opening.

15. The material mixer of claim 4, wherein said plurality of openings are circular perforations that extend about a perimeter of said at least one mixer hole in a predetermined configuration.

16. The material mixer of claim 15, wherein each of said plurality of openings are smaller than said at least one mixer hole.

17. The material mixer of claim 4, wherein said lip extends outwardly and away from said lid sidewalls.

18. The material mixer of claim 1, wherein lid sidewalls are tapered.

* * * * *